US009808138B1

(12) United States Patent
Cao

(10) Patent No.: US 9,808,138 B1
(45) Date of Patent: Nov. 7, 2017

(54) ROTARY MOP AND A ROTARY STRUCTURE OF ITS MOP HANDLE

(71) Applicant: Zhejiang DiMei Intelligent Technology Co.,Ltd, ZheJiang Province (CN)

(72) Inventor: Zhengwei Cao, Zhe Jiang Province (CN)

(73) Assignee: Zhejiang DiMei Intelligent Technology Co., Ltd, ZheJiang Province (CN)

( * ) Notice: Subject to any disclaimer, the term of this patent is extended or adjusted under 35 U.S.C. 154(b) by 0 days.

(21) Appl. No.: 15/380,564

(22) Filed: Dec. 15, 2016

(30) Foreign Application Priority Data

May 17, 2016 (CN) ..... 2016 2 0447780 U

(51) Int. Cl.
*A47L 13/20* (2006.01)
*B25G 3/38* (2006.01)

(52) U.S. Cl.
CPC ..... *A47L 13/20* (2013.01); *B25G 3/38* (2013.01)

(58) Field of Classification Search
CPC ..... A47L 13/20; A47L 13/254; B25G 3/38
See application file for complete search history.

(56) References Cited

U.S. PATENT DOCUMENTS 9,021,648 B1 * 5/2015 Chu ..... B25G 1/002 15/119.1
9,085,078 B1 7/2015 Huang
2011/0214241 A1 * 9/2011 Wang ..... A47L 13/20 15/228
2012/0090122 A1 * 4/2012 Lin ..... A47L 13/58 15/228
2015/0282685 A1 10/2015 Zhu
2016/0324389 A1 11/2016 Mangano et al.

FOREIGN PATENT DOCUMENTS

CN 203524600 U * 4/2014

* cited by examiner

*Primary Examiner* — Shay Karls
(74) *Attorney, Agent, or Firm* — Black, McCuskey, Souers & Arbaugh, LPA

(57) ABSTRACT

Described herein is a rotary mop and a rotary structure of a mop handle of the rotary mop. The rotary structure comprises a rotary cylinder of which the inner wall is provided with spiral grooves and a lifting rod penetrating through the rotary cylinder, wherein the lifting rod is provided with a unidirectional rotary one-way bearing, bulges matched with the spiral grooves are apart arranged outside the one-way bearing, when the lifting rod is pressed downwards, the one-way bearing stops rotation, and the bulges and the spiral grooves are mutually matched to drive the rotary cylinder to rotate; and when the lifting rod is pulled upwards, the one-way bearing idly rotates along the spiral grooves. The bottom of the rotary cylinder is provided with a bottom plate for sealing the rotary cylinder, and lubricating oil or lubricating grease is provided in the rotary cylinder.

10 Claims, 7 Drawing Sheets

ROTARY MOP AND A ROTARY STRUCTURE OF ITS MOP HANDLE

This application claims priority to Chinese Patent Application No. 201620447780.9, filed May 17, 2016. The contents of the aforementioned application is hereby incorporated by reference herein in its entirety.

TECHNICAL FIELD

The present utility model relates to the technical field of mops, in particular to a rotary mop and a rotary structure of a mop handle of the rotary mop.

RELATED ART

Since the rotary mop is capable of automatically cleaning and spin-drying, the rotary mop is very popular with the majority of users, and a mop rod of such mop consists of an upper pipe and a lower pipe, which are movably connected by a rotary device. The rotary device on the market at present realizes rotation by disposing a rotary head and a spiral transmission shaft which are provided with matched ratchets, when the mop of such structure is pulled up and pressed down, power of the rotary head is transmitted to the transmission shaft after the ratchets of the rotary head and the transmission shaft are meshed, according to the structure, the sliding faces of two transmission teeth abut against each other in a rotary process, the rotary head is easy to abrade after a friction force is generated, and the transmission shaft is easy to break after long term use; and the rotary device of the common rotary mop has more parts, the mounting is troublesome, the resistance is larger during pressing down, and the operation is strenuous.

The mop head of an automatic spin-drying mop in the prior art can rotate relatively, and realizes a centrifugal water spinning function of mop cloth, then in the process that the mop is acted by a force, the phenomenon of sliding between the mop rod and a turntable often occurs, and the mop cloth cannot rotate along with the mop rod, and thus cannot be spin-dried.

SUMMARY OF THE INVENTION

The present invention aims to provide a rotary mop, and a rotary structure of a mop handle of the rotary mop, which are simple in structure, long in service life, convenient to mount and labor saving in use.

The technical solution adopted by the present utility model to solve the technical problems is as follows:

A rotary structure of a mop handle comprises a rotary cylinder of which the inner wall is provided with spiral grooves and a lifting rod penetrating through the rotary cylinder, wherein the lower end of the lifting rod is fixedly provided with a unidirectional bearing which rotates unidirectionally; bulges matched with the spiral grooves are apart arranged outside the unidirectional bearing. When the lifting rod is pressed downwards, the unidirectional bearing stops rotating, and the bulges and the spiral grooves are mutually matched to drive the rotary cylinder to rotate; and when the lifting rod is pulled upwards, the unidirectional bearing idly rotates along the spiral grooves.

The bottom of the rotary cylinder is provided with a bottom plate for sealing the rotary cylinder, and lubricant or lubricating grease is provided in the rotary cylinder.

The upper end of the rotary cylinder is provided with a fixing part, and the middle of the fixing part is provided with a through hole slightly larger than the lifting rod in diameter.

The upper end of the lifting rod is fixedly connected to a handle.

The upper end of the rotary cylinder is provided with a buffering device sleeving the lifting rod.

In an example embodiment, the buffering device is a spring, one end of the spring abuts against the lower side of the handle and the other end of the spring abuts against the fixing part.

The buffering device comprises an elastic rubber sleeve, one end of the elastic rubber sleeve abuts against the lower side of the handle, and the other end of the elastic rubber sleeve is provided with a stress balancing piece.

The bulges are cylinders or spheres or fan blade-shaped flaky bodies.

A rotary mop is characterized in that the lower end of the rotary cylinder of the mop handle is provided with a mop head, wherein the mop head comprises a turntable, a mop rod connector, a turntable bottom buckle and a turntable limiting part, the turntable bottom buckle is fixedly installed in the middle of the lower side of the turntable, an annular flange on the lower end of the turntable limiting part is clamped between the turntable bottom buckle and the turntable and can freely rotate, the upper end of the turntable limiting part penetrates through a center through hole of the turntable and is connected with the mop rod connector, connecting pieces I are formed on the bottom surface of the turntable limiting part, and connecting pieces II are formed on the top surface of the turntable bottom buckle; an elastic part is arranged between the turntable limiting part and the turntable bottom buckle, and the elastic part enables the connecting pieces I and the connecting pieces II to tend to separate; when the mop head is spin-dried, the turntable limiting part is subjected to an external force to move down and overcome an action of the elastic part, and the connecting pieces I and the connecting pieces II abut against each other and are in transmission.

The elastic part is an annular metal piece, a plurality of elastic raised pieces are formed on one side of the metal piece, and the elastic raised pieces are annularly arranged on the lower side of the metal piece.

Compared with prior art, the present invention has the prominent and beneficial effects:

According to an example embodiment, the structure is simple, the mounting is convenient, the production cost is reduced, the service life is long, a conventional rotary structure is changed, the rotating flexibility of the bulges of the rotary guide part in the spiral grooves is higher, the match between dots and the spiral grooves is smooth, and pulling up or pressing down is very labor saving and easy; the mop head is fixed by the turntable and the turntable bottom buckle through a fastener, the turntable bottom buckle abuts against or is separated from the turntable limiting part by the elastic part, therefore, the turntable limiting part is enabled to drive the turntable bottom buckle to synchronously rotate and ensures no sliding of the turntable, and thus the water spinning efficiency and practicability of the rotary water spinning mop are improved.

DETAILED DESCRIPTION

Figure 1:
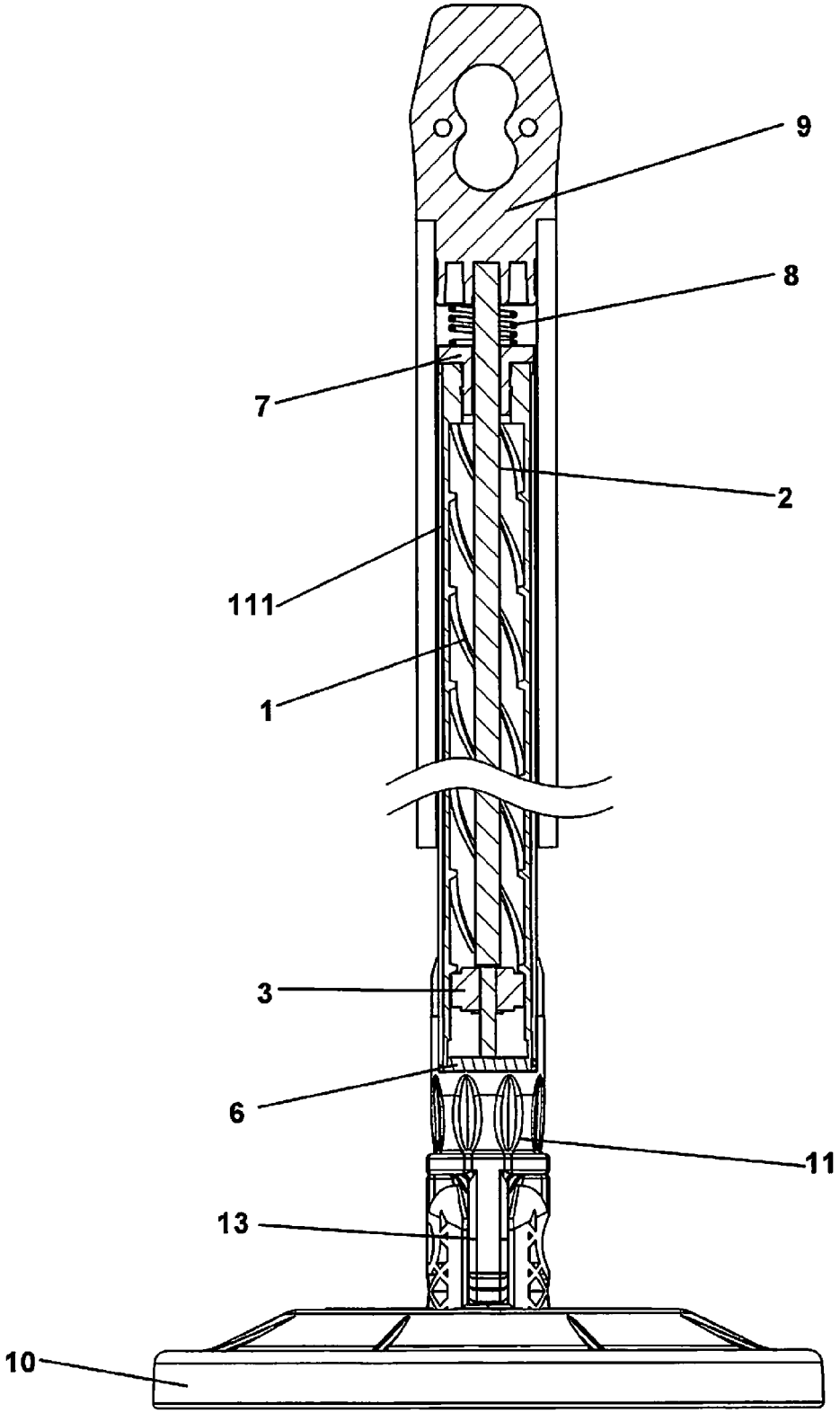
FIG. 1 is a schematic diagram of part of internal structure of the present utility model.

The present invention is further described in combination with drawings and specific embodiments:

In the drawings: 1—rotary cylinder; 111—spiral groove; 2—lifting rod; 3—unidirectional bearing; 32—bulge; 6—bottom plate; 7—fixing part; 8—spring; 81—elastic rubber sleeve; 82—stress balancing piece; 9—handle; 10—turntable; 11—mop rod connector; 12—turntable bottom buckle; 13—turntable limiting part; 14—annular flange; 15*a*—connecting pieces I; 15*b*—connecting pieces II; 16—elastic part; 17—elastic raised piece; 18—pin shaft; 19—limiting groove; 20—snap spring; 21—snap spring.

Figure 2:
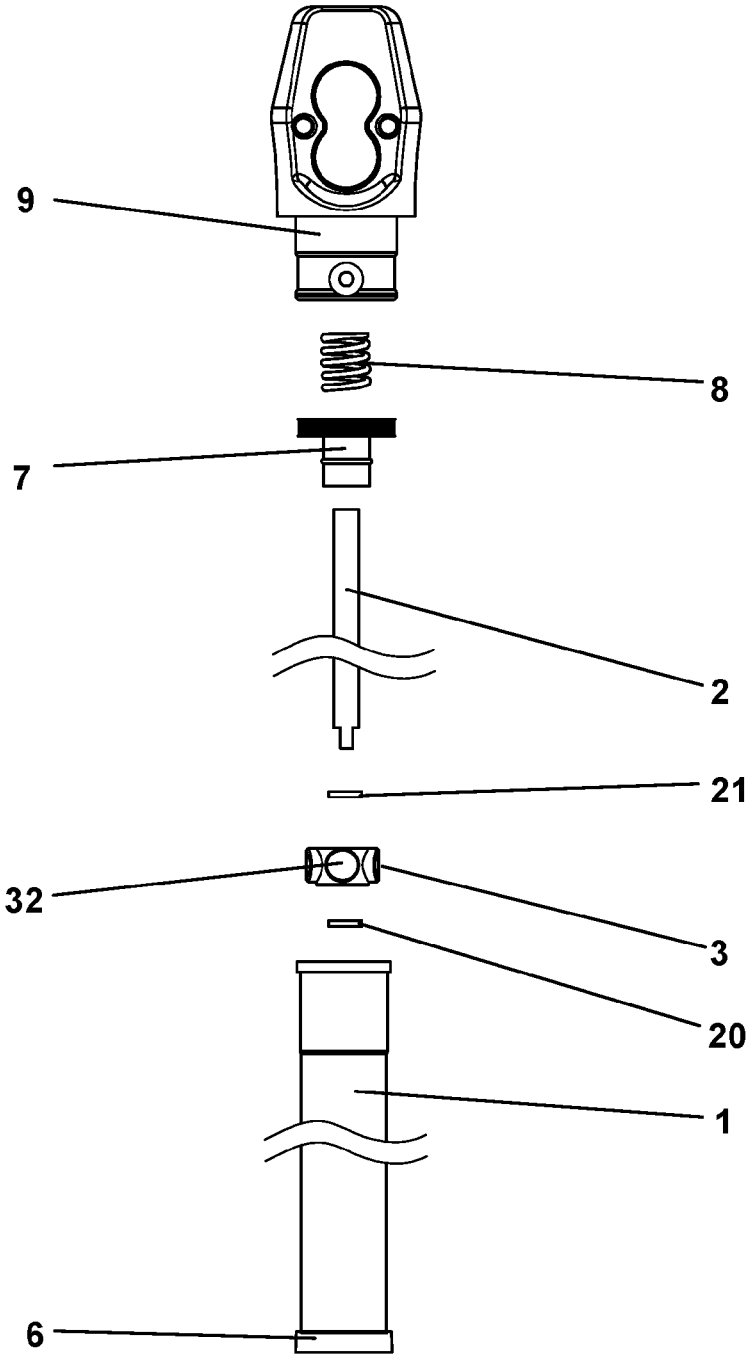
FIG. 2 is an assembly exploded view of a mop handle of the present utility model.
Figure 3:
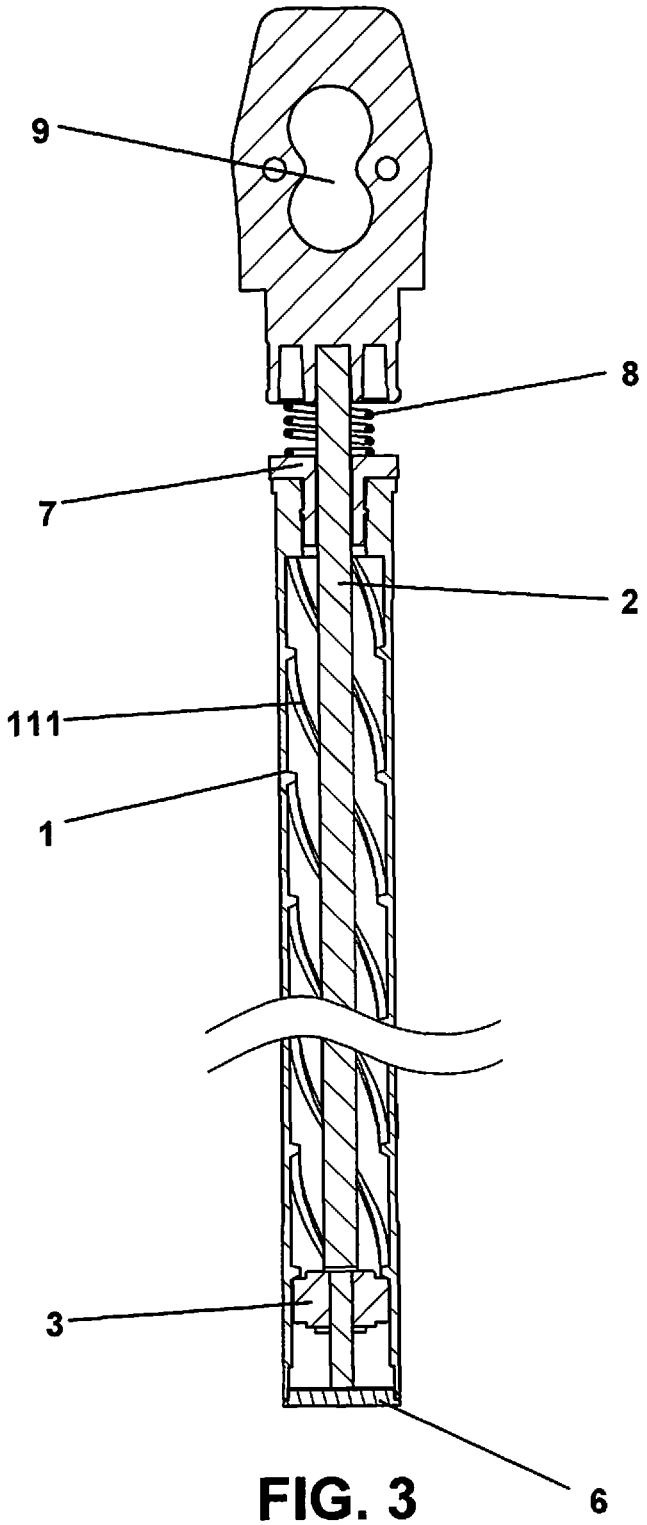
FIG. 3 is a schematic diagram of an internal structure of a mop handle provided with a spring of the present utility model.
Figure 4:
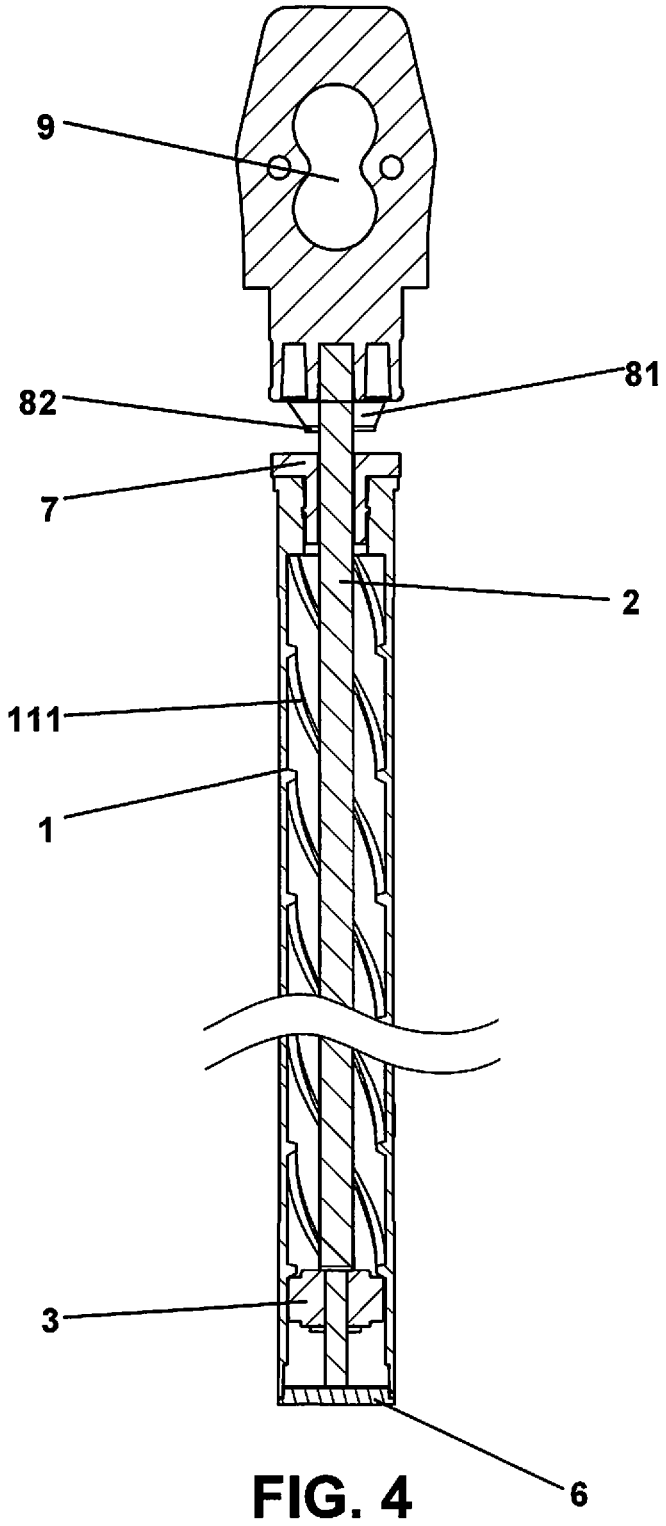
FIG. 4 is a schematic diagram of an internal structure of a mop handle provided with an elastic rubber sleeve of the present utility model.
Figure 5:
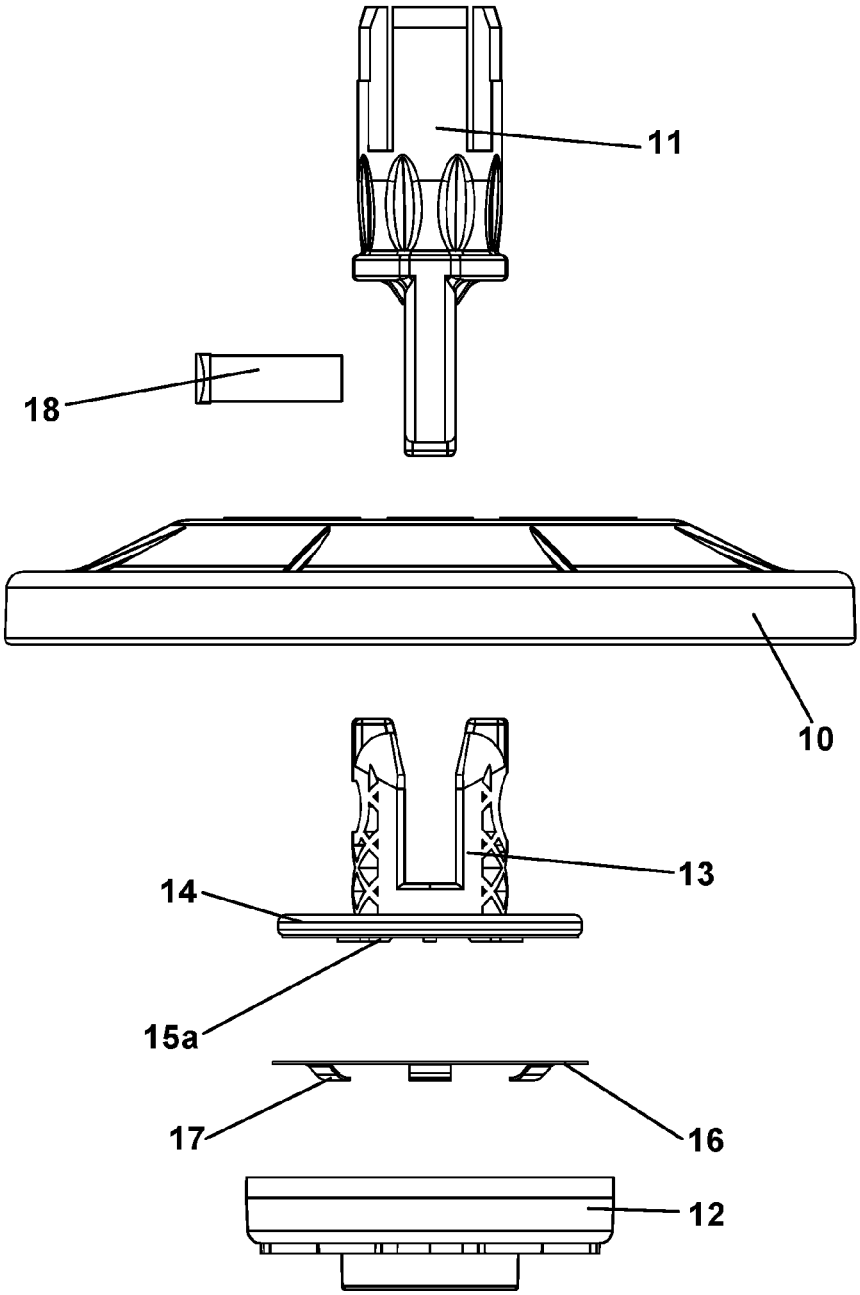
FIG. 5 is a first assembly exploded view I of a mop head of the present utility model.
Figure 6:
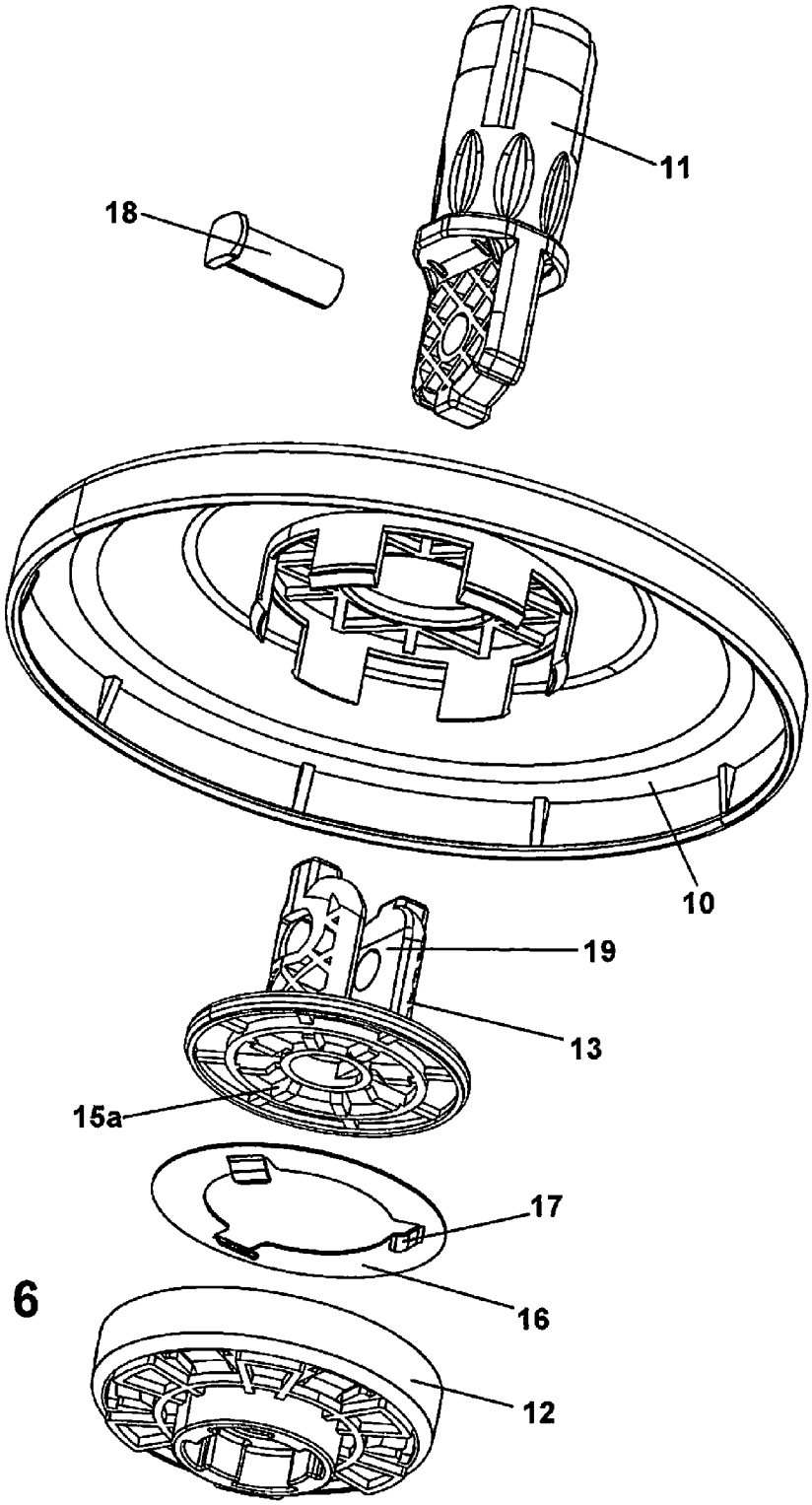
FIG. 6 is a second assembly exploded view II of a mop head of the present utility model.
Figure 7:
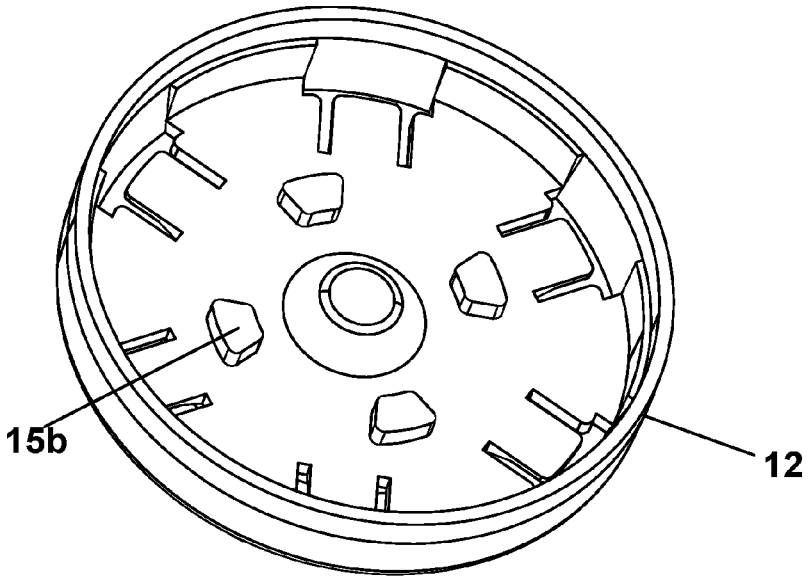
FIG. 7 is a structural schematic diagram of a turntable bottom buckle.

As shown in FIGS. 1-2, a rotary device of a rotary mop comprises a rotary cylinder 1 of which the inner wall is provided with spiral grooves 111 and a lifting rod 2 penetrating through the rotary cylinder 1, wherein the lower end of the lifting rod 2 is fixedly provided with a unidirectional bearing 3 which rotates unidirectionally; bulges 32 matched with the spiral grooves 111 are apart arranged outside the unidirectional bearing 3, when the lifting rod 2 is pressed downwards, the unidirectional bearing 3 stops rotating, and the bulges 32 and the spiral grooves 111 are mutually matched to drive the rotary cylinder 1 to rotate; and when the lifting rod 2 is pulled upwards, the unidirectional bearing 3 idly rotates along the spiral grooves 111.

The bottom of the rotary cylinder 1 is provided with a bottom plate 6 for sealing the rotary cylinder, and lubricant or lubricating grease is provided in the rotary cylinder. The lifting rod 2 is of a cylindrical rod body, replaces the conventional spiral lifting rod which is higher in manufacturing cost and easy to fracture, and the cylindrical rod body is more advantageous in aspects of machining, cost and service life. The rotary cylinder 1 is sealed by the bottom plate 6, such that the lubricant or lubricating grease in the rotary cylinder 1 is not easy to consume, the service life is indirectly prolonged, and the bottom plate can be integrally formed with the rotary cylinder or connected to the rotary cylinder by an end cover.

The upper end of the rotary cylinder 1 is provided with a fixing part 7, and the middle of the fixing part 7 is provided with a through hole slightly larger than the lifting rod in diameter. The fixing part 7 can prevent the lifting rod from shaking left and right in use.

The upper end of the lifting rod 2 is fixedly connected to a handle 9. A lifting device is controlled by the handle 9 to pull up and press down.

The upper end of the rotary cylinder 1 is provided with a buffering device sleeving the lifting rod. When pressed down, the buffering device reduces the impact of the handle and the fixing part.

The buffering device 8 is a spring, one end of the spring 8 abuts against the lower side of the handle and the other end of the spring 8 abuts against the fixing part. After the spring 8 is arranged, a hand feeling can be increased, since when an outer rod body is pressed every time, the spring is pressed, and during upward pulling, the spring gives a small elastic force, and the outer rod body can be pulled to the top by only slight pulling, and the use is more smooth and more labor saving.

The buffering device 8 comprises an elastic rubber sleeve 81, one end of the elastic rubber sleeve abuts against the lower side of the handle, and the other end of the elastic rubber sleeve 81 is provided with a stress balancing piece 82. The elastic rubber sleeve 81 achieves a buffering action, and the stress balancing piece 82 can enable the elastic rubber sleeve 81 to be uniformly stressed.

The bulges 32 are cylinders or spheres or fan blade-shaped flaky bodies, and are spheres in the present embodiment.

In an example embodiment, the lower end of the rotary cylinder of the mop handle is provided with a mop head, wherein the mop head comprises a turntable 10, a mop rod connector 11, a turntable bottom buckle 12 and a turntable limiting part 13, the turntable bottom buckle 12 is fixedly installed in the middle of the lower side of the turntable 10, an annular flange 14 on the lower end of the turntable limiting part 13 is clamped between the turntable bottom buckle 12 and the turntable 10 and can freely rotate, the upper end of the turntable limiting part 13 penetrates through a center through hole of the turntable 10 and is connected with the mop rod connector 11, connecting pieces I 15*a* are formed on the bottom surface of the turntable limiting part 13, and connecting pieces II 115*b* are formed on the top surface of the turntable bottom buckle 12; an elastic part 16 is arranged between the turntable limiting part 13 and the turntable bottom buckle 12, and the elastic part enables the connecting pieces I 15*a* and the connecting pieces II 15*b* to tend to separate; when the mop head is spin-dried, the turntable limiting part 13 is subjected to an external force to move down and overcome an action of the elastic part 16, and the connecting pieces I 15*a* and the connecting pieces II 15*b* abut against each other and are in transmission. The upper end of the turntable limiting part 13 is provided with an inward concave limiting groove 19, and the turntable limiting part 13 and the mop rod connector 11 are fixedly connected by the limiting groove 19 and a pin shaft 18. However, as those skilled in the art can readily appreciate, the mop head just described is but one example of a mop head that can be coupled with the lower end of the rotary cylinder, and that in other embodiments any suitable type of mop head may be coupled with the lower end of the rotary cylinder and therefore, the invention as described herein should not be construed as limited to any specific type of mop head.

The elastic part 16 is an annular metal piece, a plurality of elastic raised pieces 17 are formed on one side of the metal piece, and the elastic raised pieces 17 are annularly arranged on the lower side of the metal piece. Since the elastic part 16 is arranged between the turntable limiting part 13 and the turntable bottom buckle 12, due to being downwards stressed, the elastic part 16 is pressed to enable the turntable limiting part 13 to abut against the protruded portion of the turntable bottom buckle 12, thereby realizing the clamping of the turntable 10 and the mop handle; the mop handle drives the turntable 10 to rotate in the stressing process, and ensures no sliding.

The above embodiments are merely preferable embodiments of the present invention rather than accordingly limiting a protection scope of the present invention, therefore, all the equivalent changes made according to the structure, shape and principle of the present invention fall within the protection scope of the present invention.

What is claimed is:

1. A rotary structure of a mop handle, comprising:

a rotary cylinder having an inner wall with spiral grooves;

a lifting rod located inside the rotary cylinder;

a unidirectional rotary one-way bearing that is comprised of a single unitary piece; and a plurality of bulges;

wherein the lower end of the lifting rod is fixedly coupled with the unidirectional rotary one-way bearing;

wherein the plurality of bulges are arranged outside the unidirectional rotary one-way bearing;

wherein when the lifting rod is pressed downwards, the unidirectional rotary one-way bearing stops rotation, and the bulges and the spiral grooves are mutually matched to drive the rotary cylinder to rotate; and wherein when the lifting rod is pulled upwards, the unidirectional rotary one-way bearing idly rotates along the spiral grooves.

2. The rotary structure of a mop handle according to claim 1, characterized in that the bottom of the rotary cylinder is provided with a bottom plate for sealing the rotary cylinder, and lubricating oil or lubricating grease is provided in the rotary cylinder.

3. The rotary structure of a mop handle according to claim 2, characterized in that the upper end of the lifting rod is fixedly connected to a handle.

4. The rotary structure of a mop handle according to claim 1, characterized in that the upper end of the rotary cylinder is provided with a fixing part, and the middle of the fixing part is provided with a through hole slightly larger than the lifting rod in diameter.

5. The rotary structure of a mop handle according to claim 4, characterized in that upper end of the rotary cylinder is provided with a buffering device sleeving the lifting rod.

6. The rotary structure of a mop handle according to claim 5, characterized in that the buffering device is a spring, one end of the spring abuts against the lower side of the handle and the other end of the spring abuts against the fixing part.

7. The rotary structure of a mop handle according to claim 5, characterized in that the buffering device comprises an elastic rubber sleeve, one end of the elastic rubber sleeve abuts against the lower side of the handle, and the other end of the elastic rubber sleeve is provided with a stress balancing piece.

8. The rotary structure of a mop handle according to claim 1, characterized in that the bulges are cylinders or spheres or fan blade-shaped flaky bodies.

9. A rotary mop, characterized by comprising the mop handle according to claim 1, wherein the lower end of the rotary cylinder of the mop handle is provided with a mop head, and the specific structure of the mop head comprises a turntable, a mop rod connector, a turntable bottom buckle and a turntable limiting part, the turntable bottom buckle is fixedly installed in the middle of the lower side of the turntable, an annular flange on the lower end of the turntable limiting part is clamped between the turntable bottom buckle and the turntable and can freely rotate, the upper end of the turntable limiting part penetrates through a center through hole of the turntable and is connected with the mop rod connector, connecting pieces I are formed on the bottom surface of the turntable limiting part, and connecting pieces II are formed on the top surface of the turntable bottom buckle; an elastic part is arranged between the turntable limiting part and the turntable bottom buckle, and the elastic part enables the connecting pieces I and the connecting pieces II to tend to separate; when the mop head is spin-dried, the turntable limiting part is subjected to an external force to move down and overcome an action of the elastic part, and the connecting pieces I and the connecting pieces II abut against each other and are in transmission.

10. The rotary mop according to claim 9, characterized in that the elastic part is an annular metal piece, a plurality of elastic raised pieces are formed on one side of the metal piece, and the elastic raised pieces are annularly arranged on the lower side of the metal piece.

* * * * *